US005964032A

United States Patent [19]

Orikasa et al.

[11] Patent Number: 5,964,032

[45] Date of Patent: Oct. 12, 1999

[54] METHOD FOR ASSEMBLING HEAD UNITS

[75] Inventors: Tsuyoshi Orikasa, Musashimurayama; Tsunenobu Satoi, Yokohama; Seiji Suzuki, Kawasaki; Seiichiro Karita, Yokohama; Masahiko Higuma, Tohgane, all of Japan

[73] Assignee: Canon Kabushiki Kaisha, Tokyo, Japan

[21] Appl. No.: 08/935,353

[22] Filed: Sep. 22, 1997

Related U.S. Application Data

[63] Continuation of application No. 08/237,892, May 4, 1994, abandoned.

[30] Foreign Application Priority Data

May 7, 1993 [JP] Japan ..... 5-130090
May 7, 1993 [JP] Japan ..... 5-130093

[51] Int. Cl.[6] ..... B41J 2/145

[52] U.S. Cl. ..... 29/890.1; 29/407.05; 156/64; 347/19

[58] Field of Search ..... 29/890.1, 407.01, 29/407.05; 347/19, 49; 156/64

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/146 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,675,696 | 6/1987 | Suzuki | 347/43 |
| 4,723,129 | 2/1988 | Endo et al. | 346/1.1 |
| 4,740,796 | 4/1988 | Endo et al. | 346/1.1 |
| 5,243,755 | 9/1993 | Inaba et al. | 29/890.1 |
| 5,373,633 | 12/1994 | Satoi et al. | 29/890.1 |
| 5,539,434 | 7/1996 | Fuse | 347/19 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—P. W. Echols
*Attorney, Agent, or Firm*—Fitzpatrick, Cella, Harper & Scinto

[57] ABSTRACT

This invention relates to an assembly method, for head units mounting a plurality of head chips for discharging ink onto a frame, in which relative positions among head chips are determined and which the head chips are secured onto the frame so as to maintain the relative positions, to an assembly apparatus for head units based on the method, and further to an ink jet output apparatus incorporating those head units. According to this invention, correction by each image output will not be required because the head unit is able to complete adjustments of shifts of arrival positions of ink at its assembling stage, thereby making the apparatus compact and simple. In addition, correction of positional shifts will not be required when the heads are replaced, so that maintenance of the ink jet output apparatus will be easy.

8 Claims, 16 Drawing Sheets

METHOD FOR ASSEMBLING HEAD UNITS

This application is a continuation of application Ser. No. 08/237,892 filed May 4, 1994, now abandoned.

CROSS-REFERENCE TO RELATED APPLICATION

This application claims priority benefits under 35 U.S.C §119 of Japanese applications Serial No. 5-130,090, No. 5-130,093, both filed May 7th, 1993, the entire disclosure of which is incorporated herein by reference.

BACKGROUND OF THE INVENTION

1. Field of the Invention

This invention relates to method and apparatus for assembling head units, constituted of plural ink jet type head chips arranged onto a frame, and an ink jet output apparatus.

2. Description of Related Art

An ink jet type output method in which an image is formed by discharging ink droplets is currently both quite popular and widely used, since this method results in printers which are quiet and compact. In such ink jet methods, a plurality of head chips having linearly arrayed nozzles for discharging ink is arranged onto a carriage with a fixed space between them, and each color ink is discharged through the corresponding head chip to obtain a color image. In such a color output apparatus, arrival accuracy of ink discharged from each head chip greatly affects image quality. For example, in the case of recording of 360 dpi, each recording pitch is around 70 $\mu$m per recording spot. If the line shifts more than a half recording spot, the image quality would be extremely impaired. In particular, it is still quite difficult to produce identical chips, and so slight variations in the chips which arise during chip production may cause the ejected ink to arrive at the recording medium with a slight positional deviation. Accordingly, effective correction of such shifts is required to keep high image quality.

A conventional ink jet output apparatus of a serial type with a carriage mounting plural head chips has corrected such shifts in the following manner. In one method, where the apparatus is built with head chips individually mounted onto the carriage, each head chip's tendency is checked, and the mounting position thereof is adjusted to correct positional shifts of arrival positions of ink. In another method, where the apparatus is built with head chips formed in a united body with an ink cartridge, ink is discharged from the head chips at a time that the apparatus is operated; the arrival positions of ink are measured to provide information to be stored in a memory; and timings of discharging ink are electrically controlled based on the information stored.

Any method described above, however, makes an assembly line of the apparatus complicated and thereby increases production costs. In addition, in the method in which each head chip is adjusted and mounted, special skill is required to replace the heads, so that users can not replace the heads and no one can do maintenance on the apparatus easily. In the method in which positional shifts are electrically adjusted, the apparatus may be formed in a large size, and therefore, the apparatus can not be used for a compact image output apparatus.

SUMMARY OF THE INVENTION

It is an object of the invention to provide method and apparatus for assembling output head units, simplifying the output apparatus, realizing high arrival accuracy of ink, and enabling users to easily replace the head units, and further to provide an ink jet output apparatus.

The foregoing object is accomplished with a method for assembling output head units in which a plurality of head chips for discharging ink is mounted onto a frame, including steps of determining plural relative positions between one chip and another chip so as to correct shifts of arrival position of ink and securing the plurality of head chips to the frame so as to keep the relative positions.

In another aspect of the invention, an apparatus for assembling output head units includes position determining means for determining relative positions between head chips so as to correct shifts of arrival positions of ink and mounting means for adhering and securing the plural head chips to a frame so as to maintain the relative positions among the head chips.

According to the invention, the head unit is capable of completing adjustment of shifts of ink arrival positions during its assembling stage, and therefore, the apparatus will not need any correction for each image output and can be formed in a compact size and with a simple construction.

In addition to the fundamental invention as described above, the method may further include steps of recording test patterns using the head chips and determining the relative positions between the head chips using information about arrival positions of ink read out of the test patterns. As its apparatus, an assembling apparatus according to the invention may further include position determining means, which includes test pattern output means for recording test patterns using the head chips and test pattern reading means for reading the arrival positions of ink and information of sizes of discharged ink out of the test patterns.

According to these inventions, information about tendency of individual head chips is easily, precisely obtained, and high precision controls are available at a time that the relative positions among the head chips are determined.

When the head chips are mounted onto the frame, in another method for assembling according to the invention, plural head chips are positioned without being pushed against a frame wall and secured at least two points or more of the end face of each head chip by adhesive so as to separate from the frame. With this invention, the relative spacing among the head chips incorporated in the unit is not influenced from accuracy of the frame, so that the method can produce head units suitable for better image quality.

In another aspect of the invention, an ink jet output apparatus has a head unit assembled by the method and apparatus as described above. With such an ink jet output apparatus, when the head chips are to be replaced, users can replace them with the head unit without any adjustment of the unit, thereby enabling to handle the ink jet output apparatus easily. The ink jet output apparatus also needs no position control mechanism, thereby simplifying its constitution.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

An output apparatus built with head units according to the invention is used for recording apparatuses, such as printers, photocopiers, or the like, as well as industrial printing machines, dyeing machines or the like. In the embodiments described hereinafter, only recording apparatuses will be described, although this invention is not to be so limited.

First Embodiment

Assembling Apparatus for Head Units

Referring to FIGS. 1 to 4, there is described both a method and an apparatus for assembling head units according to a first embodiment of the invention.

First of all, an apparatus constructed for using the present method of assembling head units will be described in connection with FIG. 1. A test pattern recording device 1 corresponds to means for judging trends in the arrival performance of ink from each head chip C and is made from chip hold member 1*a* which holds the head chips C and a roll of recording paper 1*b* which is provided in front of the chip hold member 1*a*. Head chips C that are being held are connectable to an ink supply tank not shown and contact pins supply electrical signals to the head chips C. When recording signals are supplied to the head chips C through the contact pins, the head chips C discharge ink, as for recording of test patterns, onto the recording paper 1*b*. The recording paper 1*b* is rolled around a supply roll 1*c* and a take-up roll 1*d*. The take-up roll 1*d* subsequently takes up the recording paper 1*b* by each test pattern recording. The supply roll 1*c* and the take-up roll 1*d* are mounted on a movable stage 1*e*, thereby being capable of carrying the recording paper on which the test patterns are recorded, to the position for letting a test pattern reading device 2 read the patterns.

Figure 2:
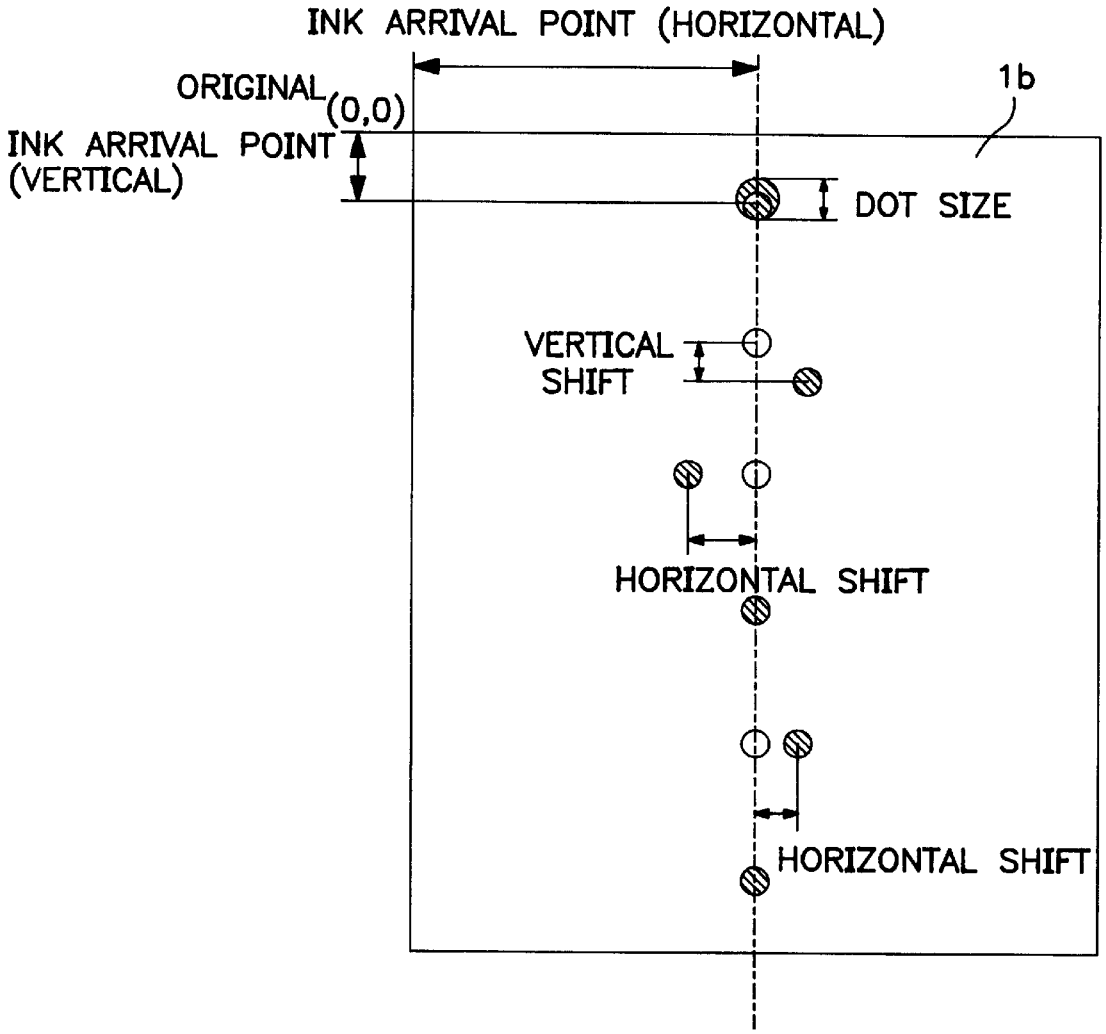
FIG. 2 is an illustration showing a test pattern at a time that ink is discharged.

The test pattern reading device 2 is used for reading the information of the test pattern recorded on the recording paper 1*b* and for judging, as well as reading the information in the recording condition, as to whether the recording condition meets a standard. The test pattern reading device 2 is composed of an optical device 2*a* irradiating light and picking up the test pattern according to reflected light from the recording paper 1*b* and of an image processing device 2*b* measuring arrival positions of ink and size of dots to analyze the test patterns and judging whether the positional shifts of the arrival positions of ink and size of dots in the test pattern meet the standard. More specifically, as shown in FIG. 2, the test pattern reading device 2 reads, as the information, amounts of vertical shifts and horizontal shifts of the arrival positions (marked by black circles) of ink on the test pattern recorded on the recording paper 1*b* against target arrival positions (marked by white circles) designated from the original points, and further sizes of dots, and judges whether each of amounts and sizes meets the standard. If each meets the standard, the head chip C is temporarily stored on a temporary storing table 4 by an auto hand 3.

The auto hand 3 is composed of a rail 3*a* extending in X direction perpendicular to a direction of discharging ink (Y direction) from the head chip C, and a movable table 3*b* which is reciprocally movable on the rail 3*a*. The movable table 3*b* is built with a chip holder 3*c* liftable in Z direction perpendicular to the X and Y directions and capable of holding the head chip C. The temporary storing table 4 is arranged near the test pattern recording device 1, and the head chips C judged as within the standard by the test pattern reading device 1 are stored on the temporarily storing table 4. These head chips C are held by the chip holder 3*c* and are secured to predetermined positions at a frame 28 mounted on a frame mounting device 5. The frame mounting device 5 is constituted of a frame holder 5*a* for holding the frame 28, a dispenser 5*b* provided adjacent to the frame 28 for applying adhesive onto the frame 28, and three optical fibers 5*c*, 5*d*, 5*e* introducing ultra-violet light for setting the adhesive. The frame holder 5*a* itself is mounted on a movable frame stage 5*f*, thereby making the held frame 28 movable in the X direction.

Assembling Process of Head Units

Figure 3:
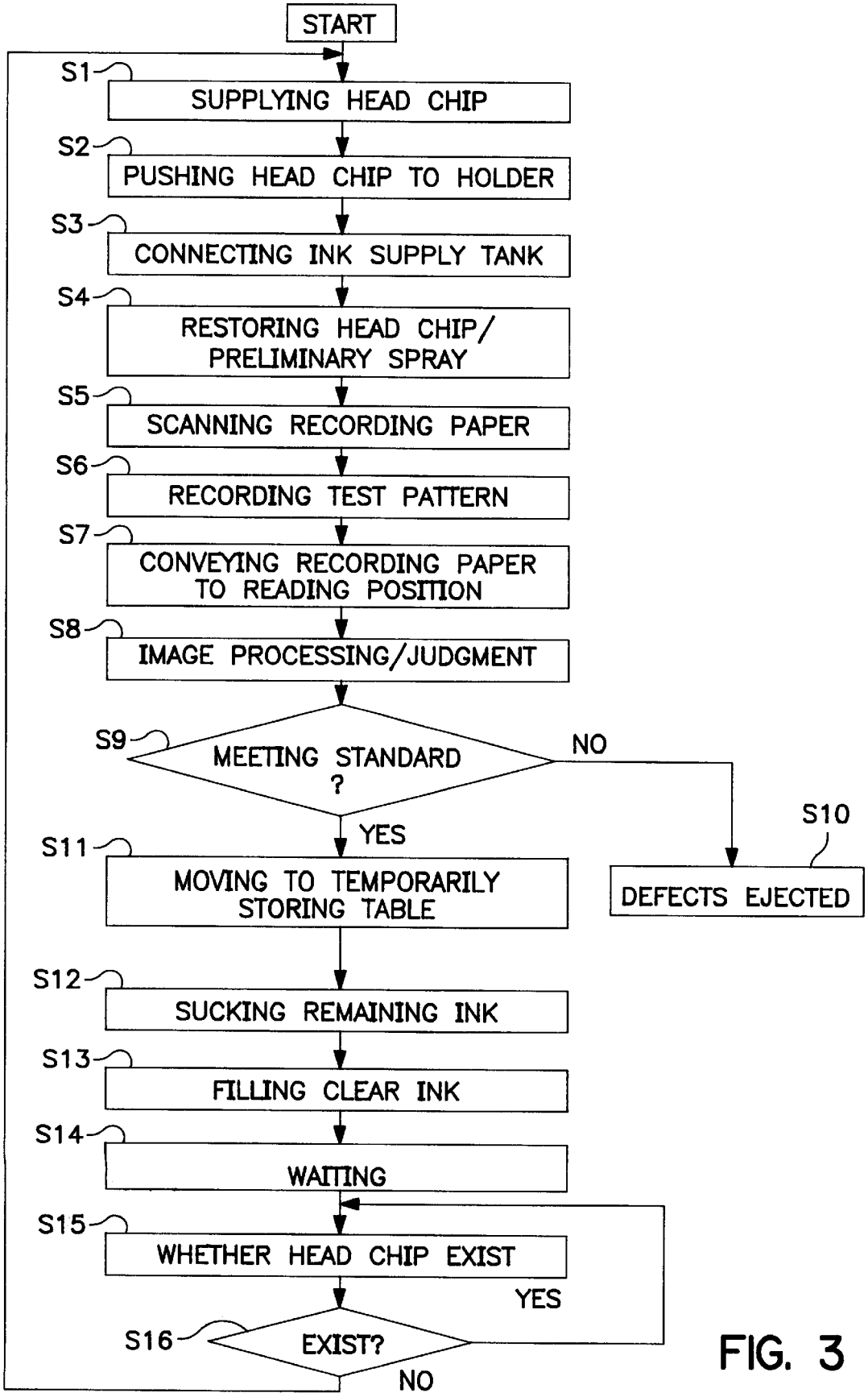
FIGS. 3, 4 are flow charts showing steps of an assembling method for head units according to the first embodiment.
Figure 4:
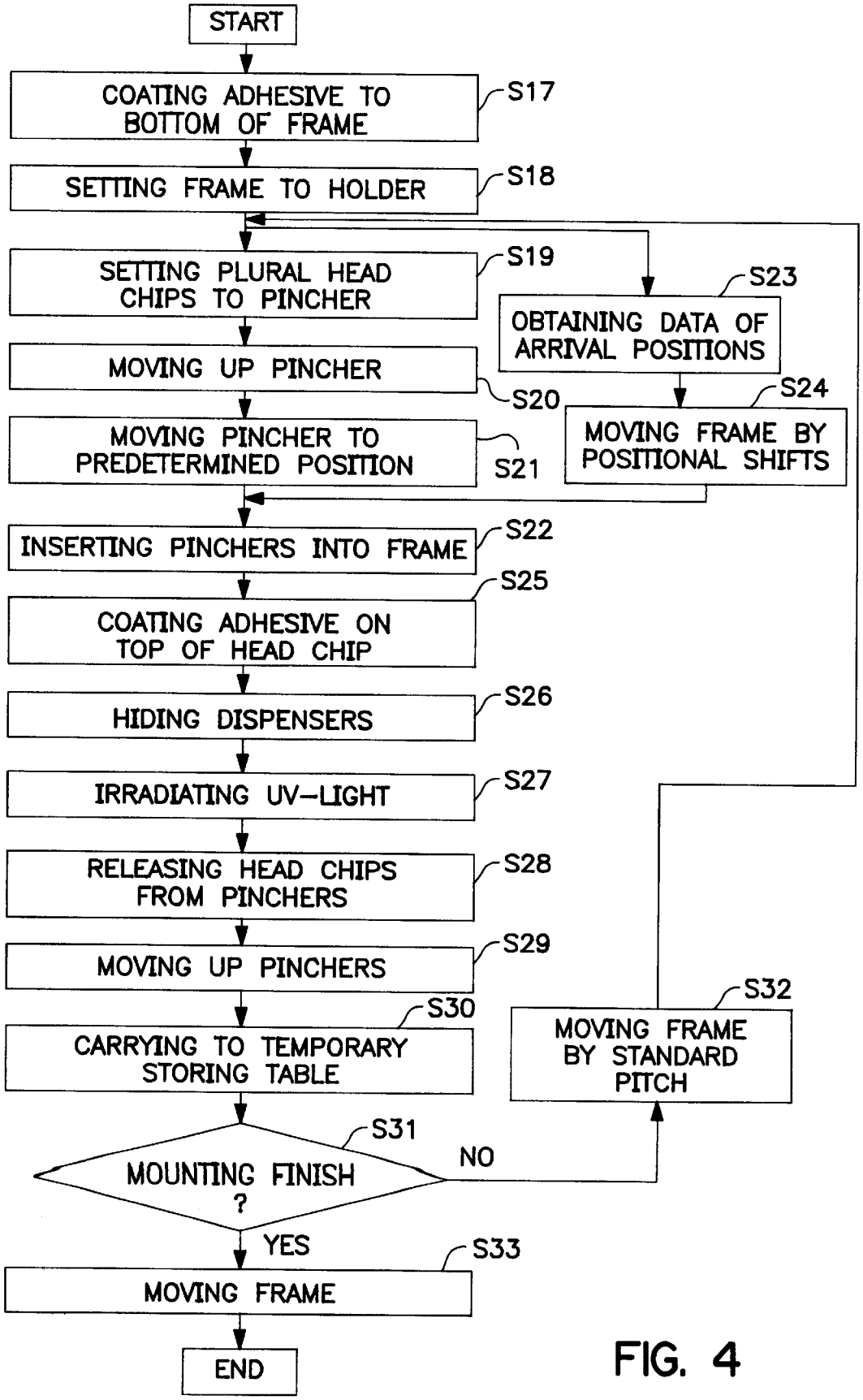

Referring to FIGS. 3, 4, which are flow charts, the process for assembling the head chips C onto the frame 28 by the apparatus is described. First of all, the head chip C is supplied to the chip hold member 1*a* by the auto hand 3 (S1), and a reference face of the head chip C is put on the holder 1*a* at its holding portion to be fixed thereto (S2). The head chip C held by holder 1*a* is connected with an ink supply tank and the contact pins for supplying electrical signals (S3). If the ink conduit in the head chip C contained air while the head chip C is connected with the ink supply tank, the head chip C would be incapable of discharging ink sufficiently. A recover device not shown in FIG. 1 may suck a fixed amount of ink from the head chip C to recover the state of the chip and clean a discharging face, and the head chip C may perform practice discharging (S4).

After the head chip C is restored by such operations so as to discharge ink normally, the recording paper 1*b* is taken around the take-up roll 1*d* by a fixed amount (S5), and then, a test pattern is recorded on the recording paper 1*b* (S6). The recording paper 1*b* is moved by the movable stage 1*e* into an observational area of the test pattern reading device 2 (S7). During this movement, the stage 1*e* precisely controls the recording start point for the recording paper 1*b* and the stop point in the observation area.

The optical device 2*a* and the image processing device 2*b* read information of arrival positions of ink and dot sizes from the test pattern (S8), and judge as to whether the read out result meets the standard (S9). As shown in FIG. 2, the judgment is made by measuring dot size, vertical shift, horizontal shift, and arrival position of ink, and by comparing the measured with the standard. In case that the read out result does not meet the standard, the head chip C was ejected as a defective product by the auto hand 3 (S10).

If the read out result meets the standard, the head chip C is carried onto the temporarily storing table 4 by the auto hand 3 (S11), and then, the remaining ink in the head chip C is sucked away (S12) and clear ink not containing dye is filled into the head chip C (S13). This purpose is to avoid the ink from clogging around a discharge opening of the head chip C by the remaining ink. The head chip C is held at the temporary storing table 4 (S14), and the temporary storing table 4 monitors whether the head chip C exists (S15, S16). If the head chip C is carried by the chip holder 3*c*, the operation for the next head chip C will begin (S1).

The head chip C filled with clear ink is held by the chip holder 3*c*, carried to a predetermined position on the frame 28, and secured by adhesive. More specifically, applying the adhesive on the bottom of the head chip C is done by applying the adhesive on the corresponding portion of the frame 28 to which the bottom of the head chip C adheres. The adhesive, therefore, is applied on the predetermined portion of the frame 28 (S17). The adhesive is applied on the frame 28 while the head chip C is filled with the clear ink.

The frame 28 on which the adhesive has been applied is then set on the frame holder 5*a* (S18), and the chip holder 3*c* holds the head chip C (S19). By moving up the chip holder 3*c* (S20), moving the movable table 3*b* along the rail 3*a* (S21), and moving down the chip holder 3*c* where the movable table 3*b* reaches the predetermined position, the head chip C is inserted into the predetermined arrangement position of the frame 28 (S22). At that time, the head chip C is held by the chip holder 3*c* without contacting any other portion of the frame 28. This is for the purpose that the head chip's position is precisely determined even where the frame 28 is roughly made. The head chips C can be arranged by this operation, and does not require any special accuracy in the frame 28 or the head chip C, relying instead upon the general mechanical accuracy of the apparatus.

When the head chips C are moved, those head chips could be arranged mechanically at equal intervals and be secured to frame 28, provided the arrival position of ink discharged by each head chip C has no shift at all. If, however, the arrival positions of respective head chips in fact have some shifts more or less, so that the shifts are corrected based on data of the arrival positions obtained from the read out result (S23, S24).

Figure 1:
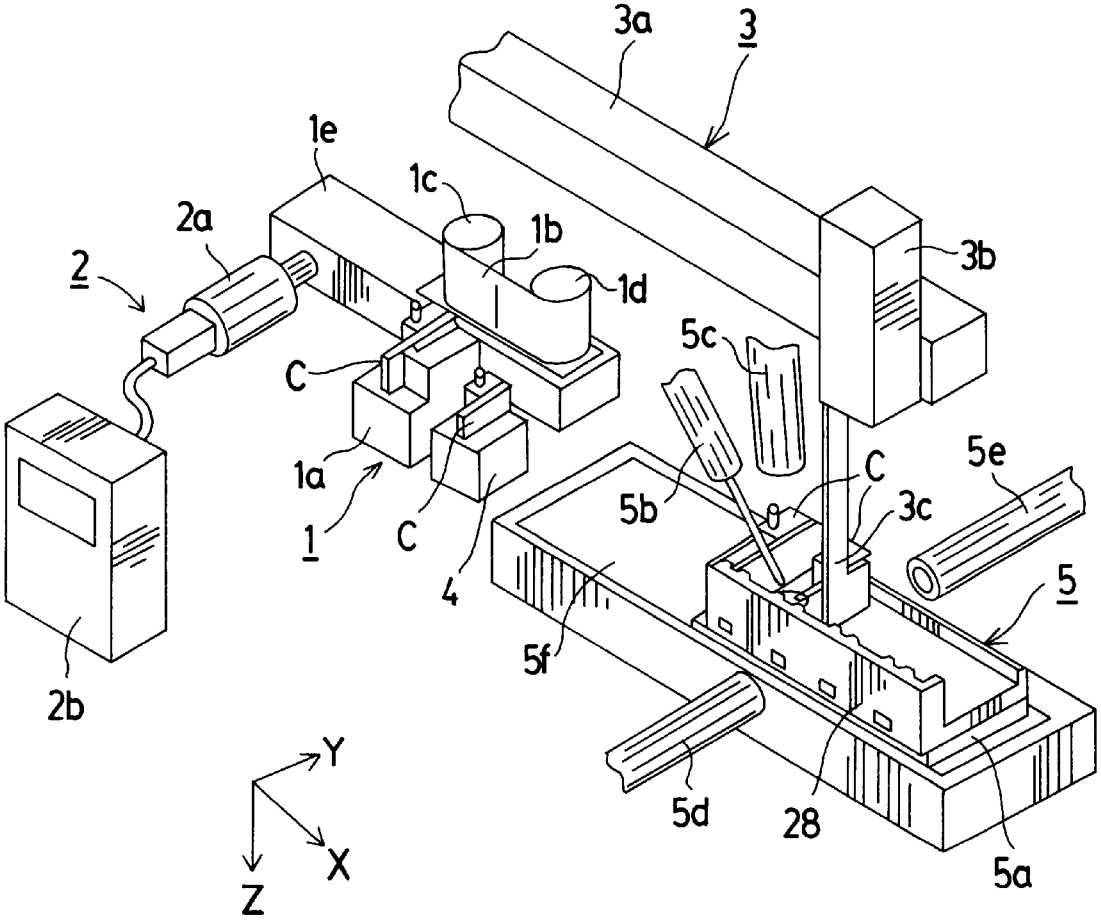
FIG. 1 is a perspective view showing an assembling apparatus for head units according to a first embodiment of the invention.

The correction in the X-direction shown in FIG. 1 can be done by correcting movement of the movable table 3*b*, and the correction in the Z-direction shown in FIG. 1 can be done by correcting downward movement of the chip holder 3*c*. In this embodiment, the correction in the X-direction is done by moving the frame 28 in the X-direction using the movable frame stage 5*f*. This is because if the moving amount on a side of the head chip C is changed in the X-direction the apparatus could be complicated since the dispenser 5*b* and the optical fibers 5*c*, 5*d*, 5*e* must be moved according to the change. Moreover, the moving accuracy (or resolution) of the movable table 3*b* may be limited in the X-direction since it requires a certain speed. To the contrary, where the frame 28 moves in the X-direction, the movable table 3*b* reciprocally moves by the same moving amount at each time, thereby significantly improving its positional reproducibility.

As the head chip C is, inserted into a predetermined position on the frame 28, as described, the adhesive applied on the frame 28 is applied to the bottom of the head chip C. The dispenser 5*b* then applies adhesive to the top of the head chip C and the frame 28 (S25). After the dispenser 5*b* is shielded from ultraviolet light (S26), the adhesive is set by irradiation of the ultraviolet light to secure the head chip C onto the frame 28 (S27). After the adhesive has been cured, the chip holder 3*c* releases the head chip C and moves up, and the movable table 3*b* is moved to catch the next head chip C stored on the temporary storing table 4 (S30).

Where the next head chip C is to be secured onto the frame 28, the frame 28 is moved by an amount of the standard pitch through driving the movable frame stage 5*f* (S31, S32), and the same operations from Step S19 are repeated. After plural head chips C are mounted on the frame 28, the frame 28 is stored in a certain place (S33). As described above, recording the test pattern of the head chip and incorporating onto the frame only the head chips C whose arrival position and dot size of ink meet the standard with corrections according to shifts of the arrival positions of ink allow the head chips guaranteeing the arrival positions of ink to be easily replaced by replacing the frames.

Constitution of Head Unit

Figure 7:
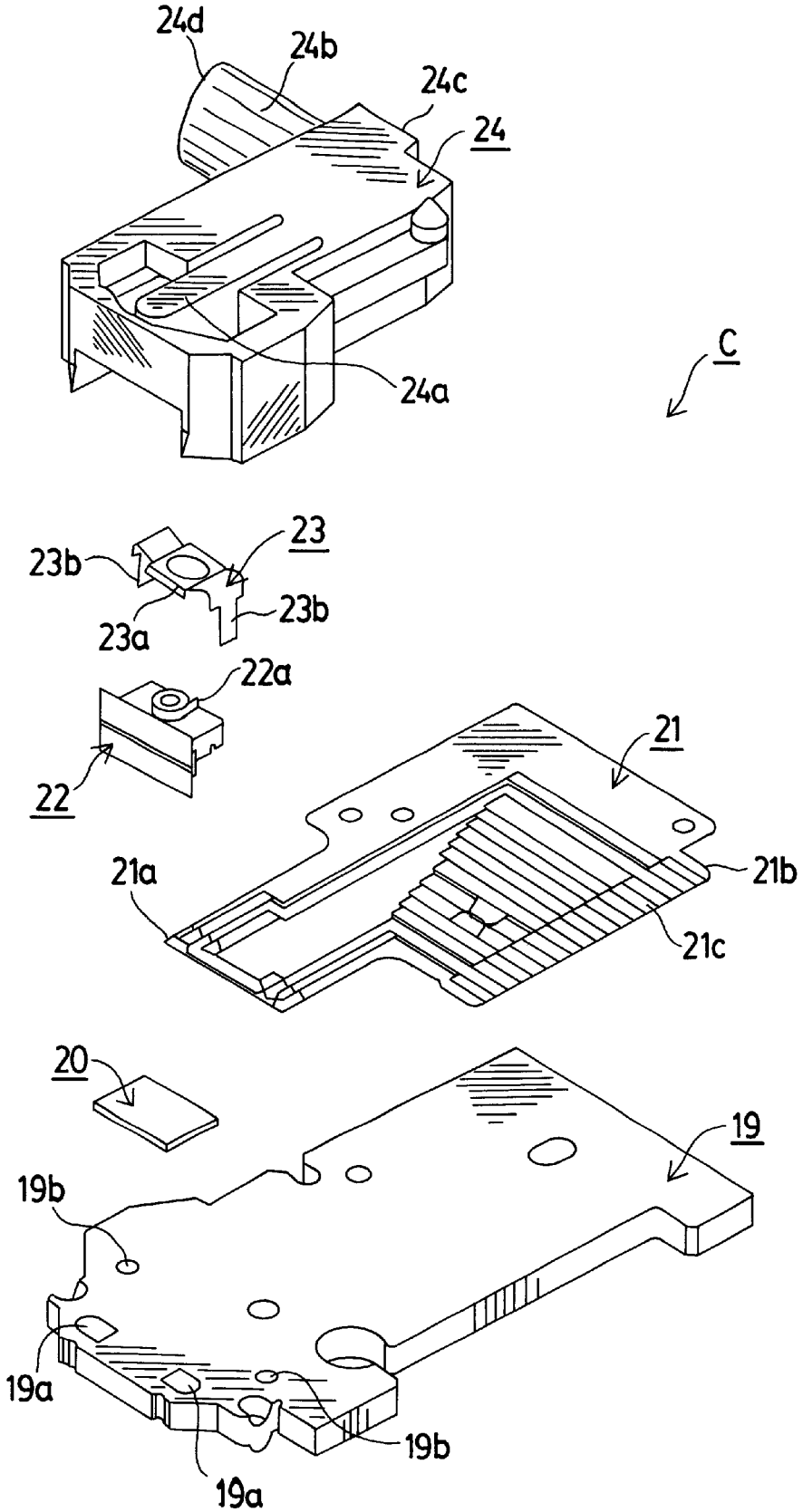
FIG. 7 is a perspective view showing a head chip.

Next, an assembly constitution of a head unit according to the present embodiment will be described. FIG. 7 shows an assembly constitution of a single head chip C. The head chip C is mounted on a metal support 19 forming a bottom portion, of a heater board 20, a circuit board 21, a top plate 22, a leaf spring member 23 for holding, and ink supply member 24, subsequently.

Figure 8:
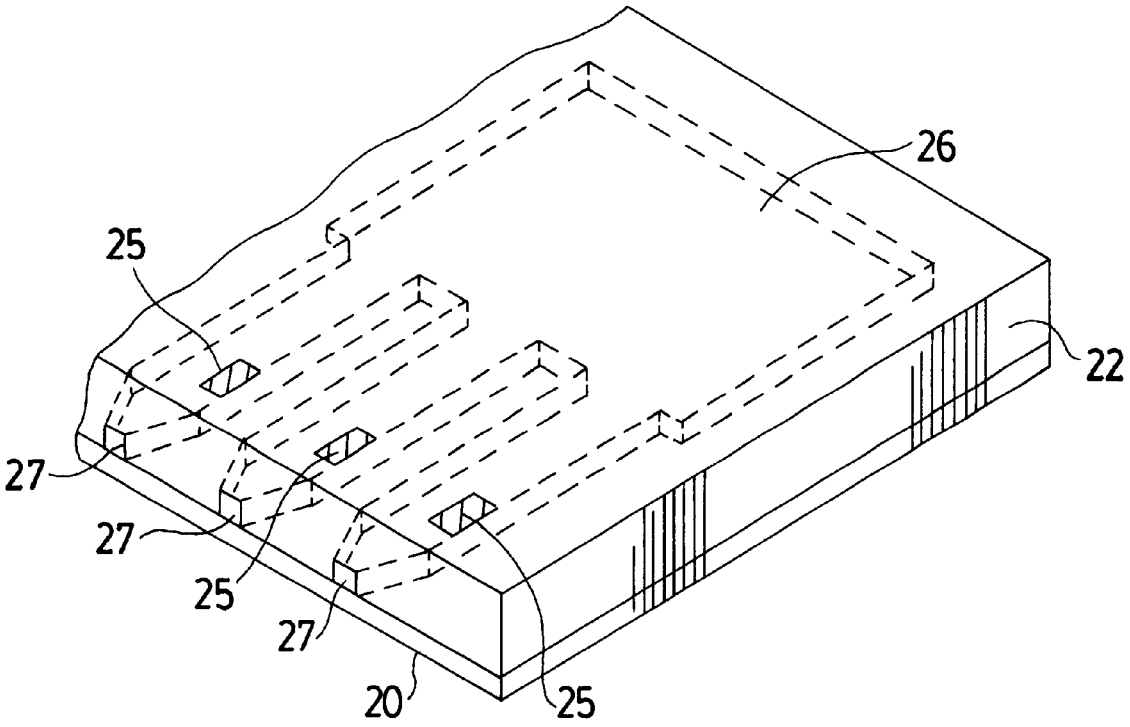
FIG. 8 is an enlarged perspective view showing a part of the head chip.

One end 21*a* of the circuit board 21 is mutually connected with the heater board 20. Plural pads 21*c* are formed, corresponding to an electric heat converter 25 arranged on a side of the apparatus body, on the other end 21*b* of the circuit board. The circuit board 21 is attached by adhesive or the like corresponding to the support 19. The leaf spring member 23 is formed in an M-shape by which a common liquid chamber 26 (shown in FIG. 8) is slightly compressed and whose front apron 23*a* concentrically pushes a part of the liquid passage, preferably, an area around a discharge opening 27, by its linear pressure. The heater board 20 and the top plate 22 are assembled so as to be stacked by engaging an end 23*b* of the leaf spring member 23 into a hole 19*a* formed on the support 19 so that the front portion engages the bottom side, and mutually fixed by concentrical pushing of the leaf spring member 23 and its front apron 23*a*. The top plate 22 is formed with an ink receiving opening 22*a*, which is connected to an ink conduit 24*a* of the ink supply member 24 described below.

The ink supply member 24 is cantilevered by an ink supply pipe 24*b* fixing the ink conduit 24*a*. A ball 24*c* for checking is inserted in the passage between the ink conduit 24*a* and the ink supply pipe 24*b*. A filter 24*d* is provided at a side end of the ink supply pipe 24*b*. The ink supply pipe 24*b* is made by molding, so that it is cheap and made accurately, that it will be produced without impairing accuracy, and that the ink conduit 24*a* having a cantilevered construction is attached with pressure to the ink receiving opening 22*a* formed at the top plate 22 even if the ink supply member 24 is mass produced. Therefore, perfect linkage can be accomplished merely by pouring adhesive for sealing from a side of the ink supply member 24 while the ink conduit 24*a* is pushed onto the ink receiving opening 22*a*. The ink supply member 24 is fixed to the supporter 19 by inserting two pins projected from the back face of the ink supply member 24 into holes 19*b* of the supporter 19, respectively, and by projecting them from the back face, and by melting them with heat.

Figure 5:
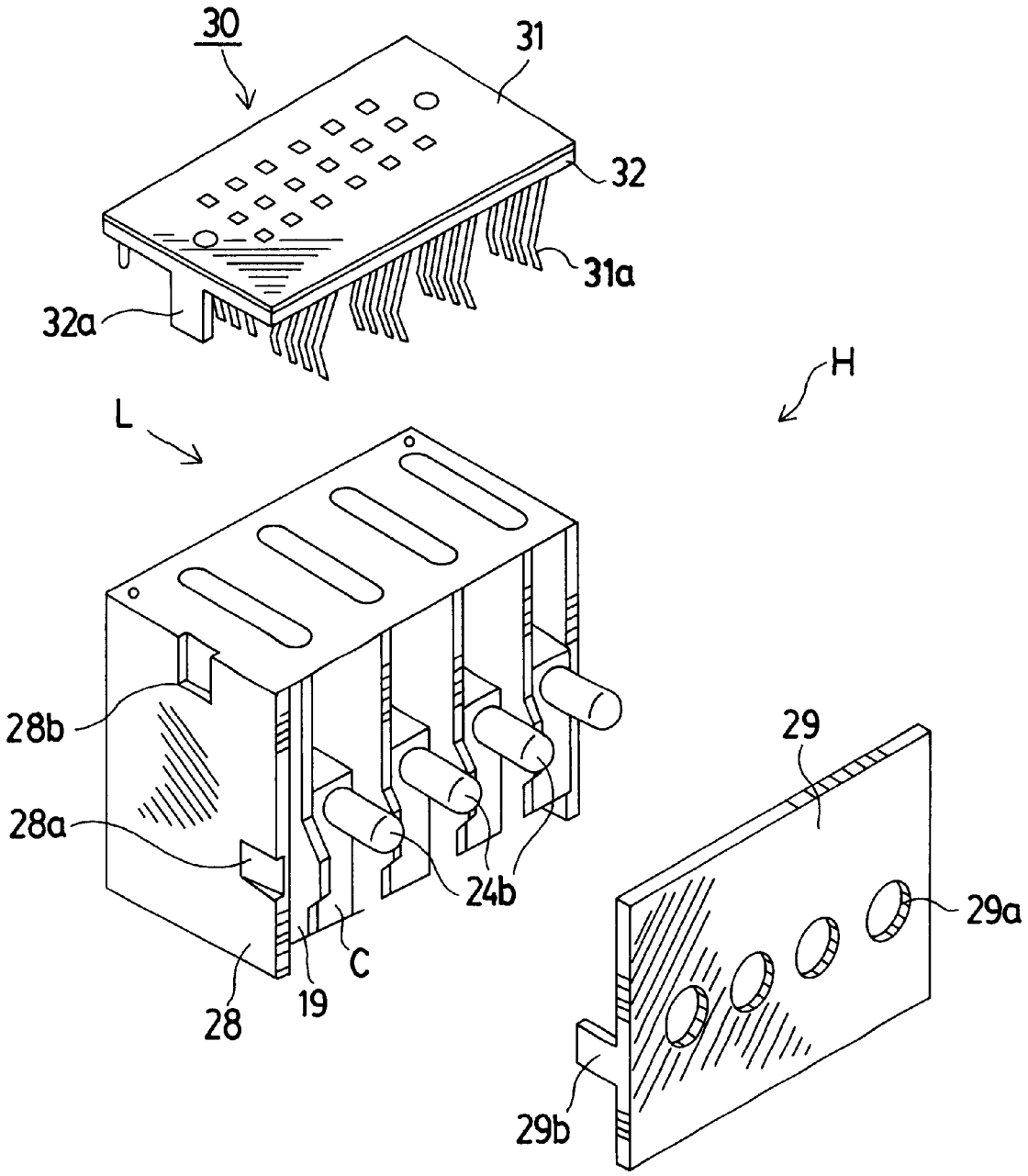
FIG. 5 is a perspective view showing a head unit.
Figure 6:
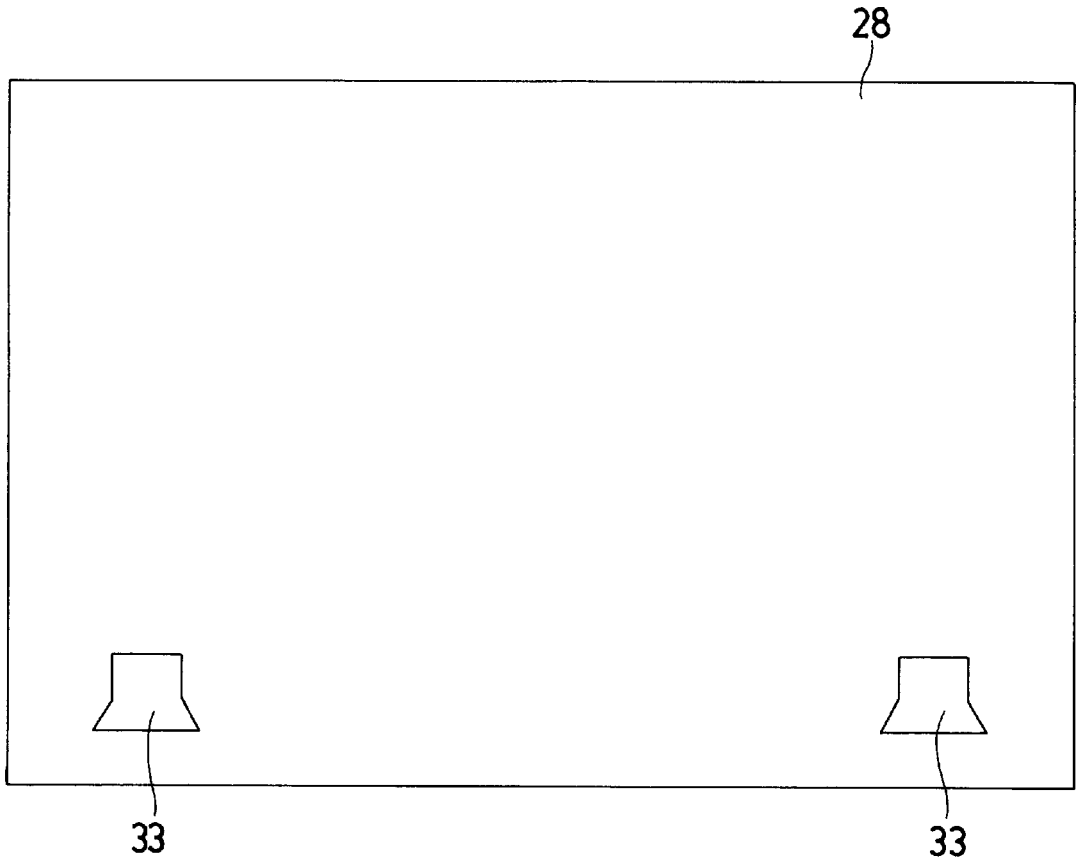
FIG. 6 is a bottom view showing the head unit.

Referring to FIGS. 5, 6, the frame 28 for positioning the head chip will be described. The frame 28 fixes a plurality of head chips C in a line and sets the head chips C in their positions at once into a groove formed among ribs as described below. After a plurality of the head chips C is mounted on the frame 28, a top cover 29 is put on the frame 28. The top cover 29 has four holes through which pass the ink supply pipes 24*b* of the head chips C. The embodiment exemplifies that the unit has four head chips C in a line. The top cover 29 is attached on the frame 28 by engaging tongues 29*b* formed at both ends of the top cover with corresponding stoppers 28*a*.

The frame 28 is covered by a cover connector 30, at which electrode pads 31 integrating electrical contacts between respective head chips C and the apparatus body into a single point and being built with flexible cables are incorporated with a cover frame 32. The cover connector 30 is formed with connectors 31*a* connecting to the head chips C. The connectors 31*a* are connected to the electrode pads 31, thereby integrating electrical contacts for the apparatus body into a single point. The cover connector 30 is attached to the frame 28 by engaging tongues 32*a* formed at the both ends of the cover frame 32 with corresponding stoppers 28*b*. In this embodiment, since each head chip C has shift registers which are not shown, the number of contacts can be equal to or less than the total number of the electrodes of the head chip C, so that each head chip C is electrically connected to the apparatus body and receives recording signals through the electric contacts integrated at the electrode pads 31. Although in this embodiment the unit having four head chips arranged in a line is shown, the unit is not limited to this. The apparatus body is electrically connected by pushing the electrode (not shown) pads on side of the apparatus body onto the electrode pads 31 incorporated in the cover connector 30 covering the frame 28.

As shown in FIG. 6, two holes 33 are formed on an outer wall on a rear side of the frame 28, or on a side of arrow L in FIG. 5. The frame 28 is positioned to the carriage 5 by fitting position pins which project from the carriage 5 into the holes 33. When attached onto the carriage 5, only the frame 28 receives attaching force, so that each head chip C can experiences only a minimum of stress from external force. The material of which the frame 28 is made has an effect on the rigidity of the frame 28, and so is chosen in association with the accuracy of the process of forming the frame, the level of attachment force to the apparatus body, and deformation at a time of handling. PPS (polyphenylene-sulfite) with filler is used in the embodiment.

Head Chip's Assembly Constitution

Figure 9A:
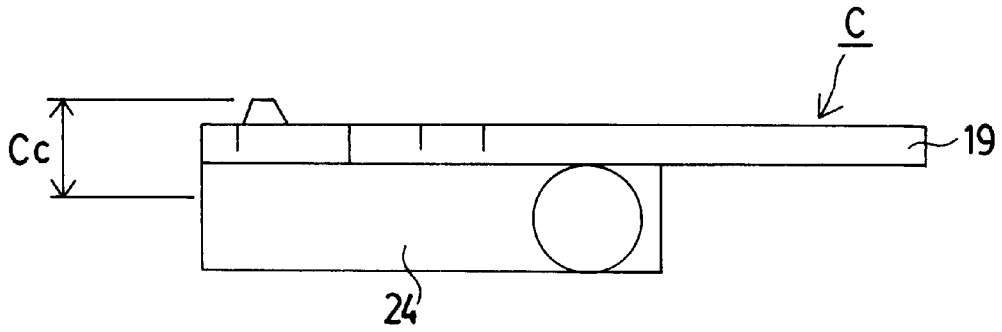
FIGS. 9A and 9B are an illustration showing an assembly position of the head chip.
Figure 9B:
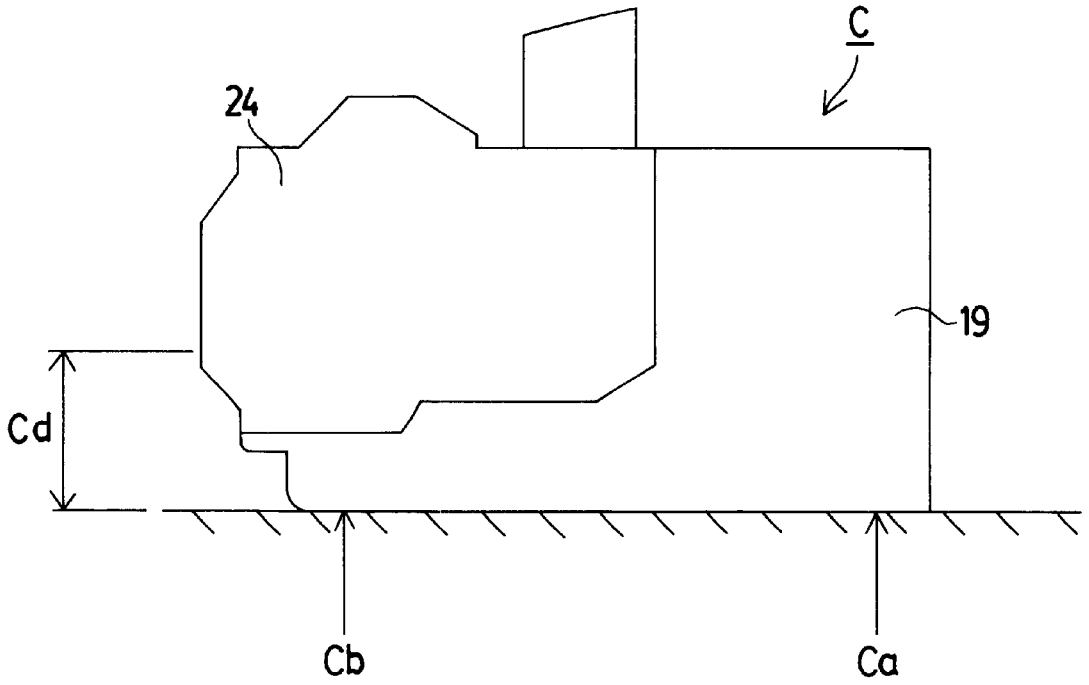
Figure 10:
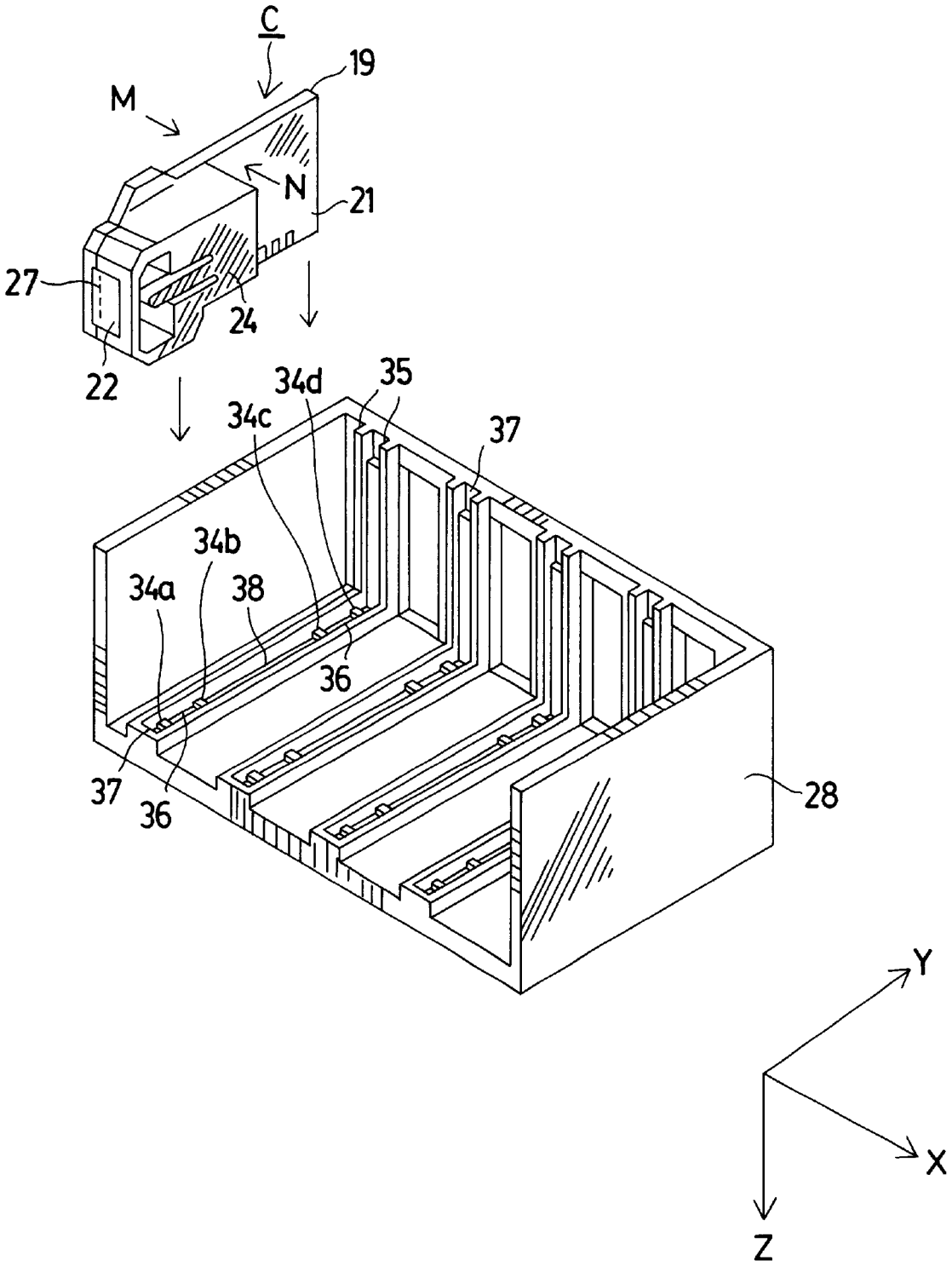
FIG. 10 is a perspective view showing the head chip and a frame to which the head chip is set.

Referring to FIGS. 9, 10, a constitution for assembling the head chips C, thus constructed, onto the carriage 5 is described. Color recording is performed by arranging a plurality of the head chips C in a line and supplying different color inks, respectively. Each head chip C must be positioned with high accuracy onto the carriage 5. The positions of the respective head chips C on the frame 28 are determined by detecting the positions at the points of arrows as shown in FIG. 10. That is, Ca, Cb represent distance up to the nozzle end in the longitudinal direction; Cc represents distance up to the nozzle end in the widthwise direction; Cd represents height up to the nozzle end.

Projections 34*a* to 34*d* and adhesive pool portions 36 between the two rails 35 are respectively formed on the bottom face of the frame 28 as shown in FIG. 10. First adhesive of a predetermined volume for fixedly supporting the head chip C is filled in the adhesive pool portion 36. Therefore, the head chip C is fixedly supported in a condition that the supporter 19 is separated from the frame 28 by the adhesive filled in the adhesive pool portion 36. The rails 35 are also formed on rear and bottom faces of the frame 28 so as to extend in a line to the Y and Z directions. Closed portions surrounded by the rail on the bottom side and by the projection 34*a* and grooves between rails on the rear side form adhesive pool portion 37. After the first adhesive has been hardened, at the adhesive pool portion 37, a second adhesive covers over the first adhesive and is filled into spaces between each end of the head chips C and the frame 28.

A recess 38 is formed between the rails 35, and, when poured from either or both of directions of arrows M, N of the supporter 19 of the head chips C, the second adhesive can be evenly applied on the both sides of the head chips C. Ultraviolet curing type adhesive is used as the first adhesive; it sets quickly; it has high efficiency of production; it becomes very hard after perfectly cured. Silicon type adhesive having elasticity compensates for weakness of the first adhesive and is capable of sufficiently filling into a narrow space and is used as the second adhesive.

A correction method for each head chip C and the frame 28 of arrival positions of ink droplets is performed by first measuring shifts of arrival positions of each head chip C, and by adhering the head chips C to be secured so that the chips C are separated from the frame 28 with by a small space using, at a time that the chips C are secured to the frame 28 with an automatic resist adjustment device, either a method for inclining the head chip C in the main scanning line direction or a method for parallel shifting it in the same direction, based on the information of the shifts. Each head chip C is thereby able to be adjusted in its position in the X, Y, and Z directions and be fixed to the frame 28, so that head chip units having higher precision than the conventional units are obtainable.

Figure 11:
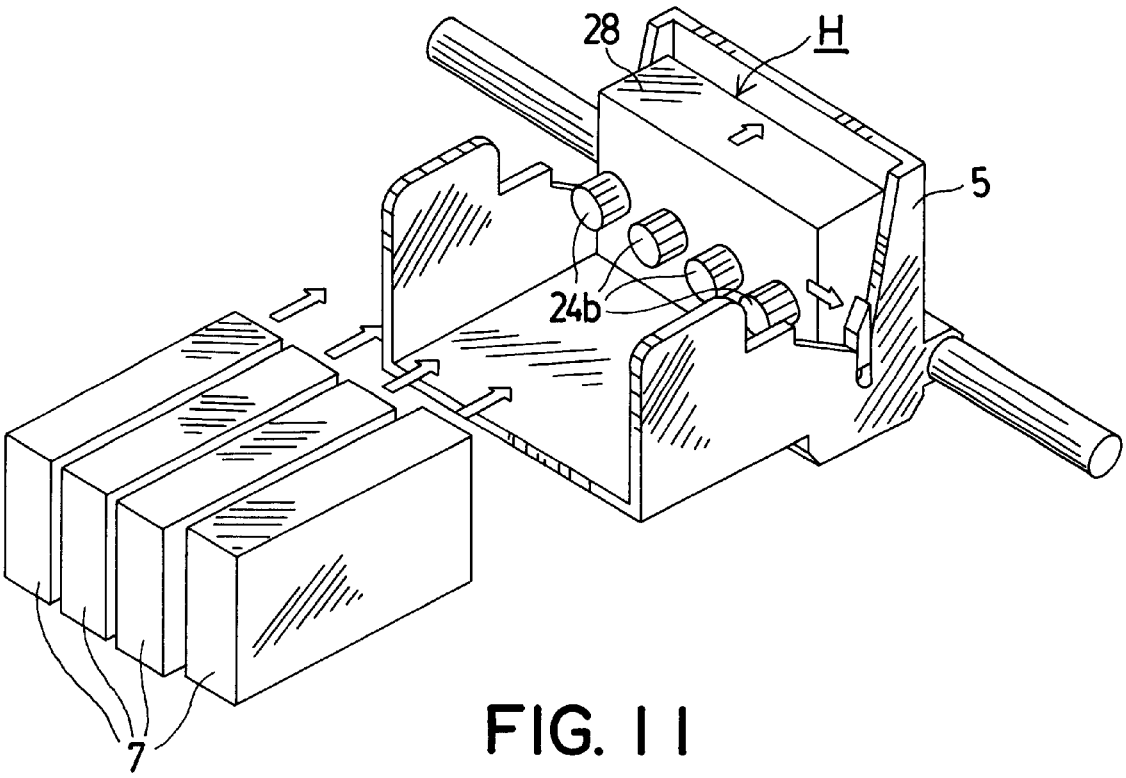
FIG. 11 is a perspective view showing the head units and a carriage to which the head units are set.

Although it may not be a problem to fill the first adhesive at at least points in the adhesive pool portion 36, the entire body can adhere along the groove between the rails 35. Although in this embodiment after the first adhesive was applied the two types adhesives are used to apply the second adhesive in a batch processing, one of cold setting adhesive, such as an epoxy system, or hot setting adhesive, can be used for securing the head chips. As shown in FIG. 11, after the frame 28 is mounted on the carriage 5, ink supply tanks 7 are respectively fitted to the ink supply pipes 24*b* projecting from the rear side of the frame 28 to mount on the carriage 5, thereby finishing the mounting process of the head chip C. Those ink supply tanks 7 are mounted to the frame 28 so as to be replaceable.

According to the constitution thus described, the head chip unit corrects the arrival position of ink of each head chip C by previously measuring each head chip's shift of arrival position of ink, adjusting, with regard to the information, the position of the head chip C in all of X, Y, and Z directions, and securing it to the frame 28, and therefore, electrical adjustment, controlled from the apparatus body, of ink discharging timings are not needed, so that the control operation become simple. Accordingly, the head units can provide stable images maintaining high quality. The head chip C does not contact directly to the frame 28 but is positioned with high accuracy so as to be separated from the frame 28 by adjustments of positions in all of X, Y, and Z directions. The head chip unit is not influenced with the accuracy on the head chip C and the frame 28, and is thereby able to reduce its production costs. In addition, positioning and holding a plurality of the head chips C on the frame 28 allows the head chip C to be handled as a unit and to make replacing work with respect to the carriage 5 easy.

Second Embodiment

In the first embodiment there was exemplified a method in which each head chip C is set to the frame 28 with correcting the shifts of arrival position of ink with respect to each head chip C when the head chip C is incorporated in the frame 28. The processing time in this method tends to be long because the time for storing the head chips C, applying the adhesive, and irradiating ultraviolet light for setting the adhesive required is in association with the number of the head chips C built in the frame 28. In this method, a plurality of correction mechanisms is needed to simultaneously set the head chips C to the frame 28 in order to reduce the time length of the process, so that the apparatus may be complicated and whose machinery accuracy may be impaired.

The assembly apparatus of the second embodiment performs, in addition, a step in which the head chips C are classified in accordance with a shift amount of ink's arrival position in the horizontal direction (X-direction) on the test pattern record between the steps S13, S14 in FIG. 3. The apparatus thus constructed allows the shifts of ink's arrival positions to fall within a range of the class even though the head chips C are built on the frame 28 with equal spaces therebetween provided the chips C are classified in the same class. Accordingly, correction steps (steps S23, S24) shown in FIG. 4 as of the first embodiment described above would become unnecessary.

Figure 12:
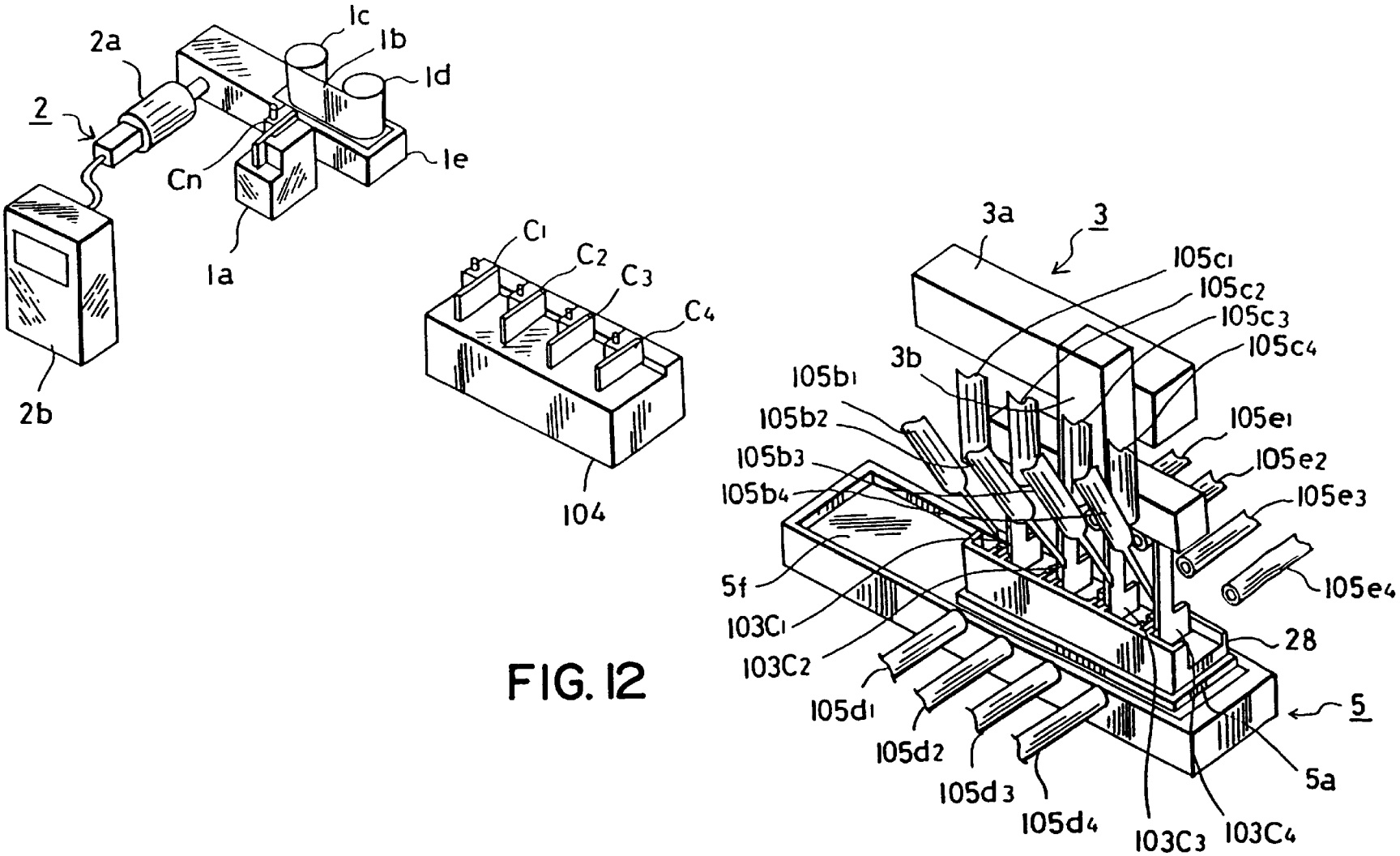
FIG. 12 is a perspective view showing an assembling apparatus for head units according to a second embodiment of the invention.

FIG. 12 shows the assembly apparatus of the second embodiment. Although having the same construction as the first embodiment, the test pattern recording device 1 has plural temporary storing tables 104 capable of holding four head chips C1 to C4, respectively. The apparatus has four holders 103C1 to 103C4 linearly arrayed, by which the four head chips C1 to C4 are held at one time and by which they are simultaneously built on the frame 28 formed on the frame holder 5. The apparatus includes, corresponding to the mounted positions of the head chips C on the frame 28, four dispensers for adhesive 105*b*1 to 105*b*4, and three optical fibers for each head chip C 105*c*1 to 105*c*4, 105*d*1 to 105*d*4, 105*e*1 to 105*e*4, thereby allowing the head chips C1 to C4 to simultaneously adhere to the frame 28.

Figure 13:
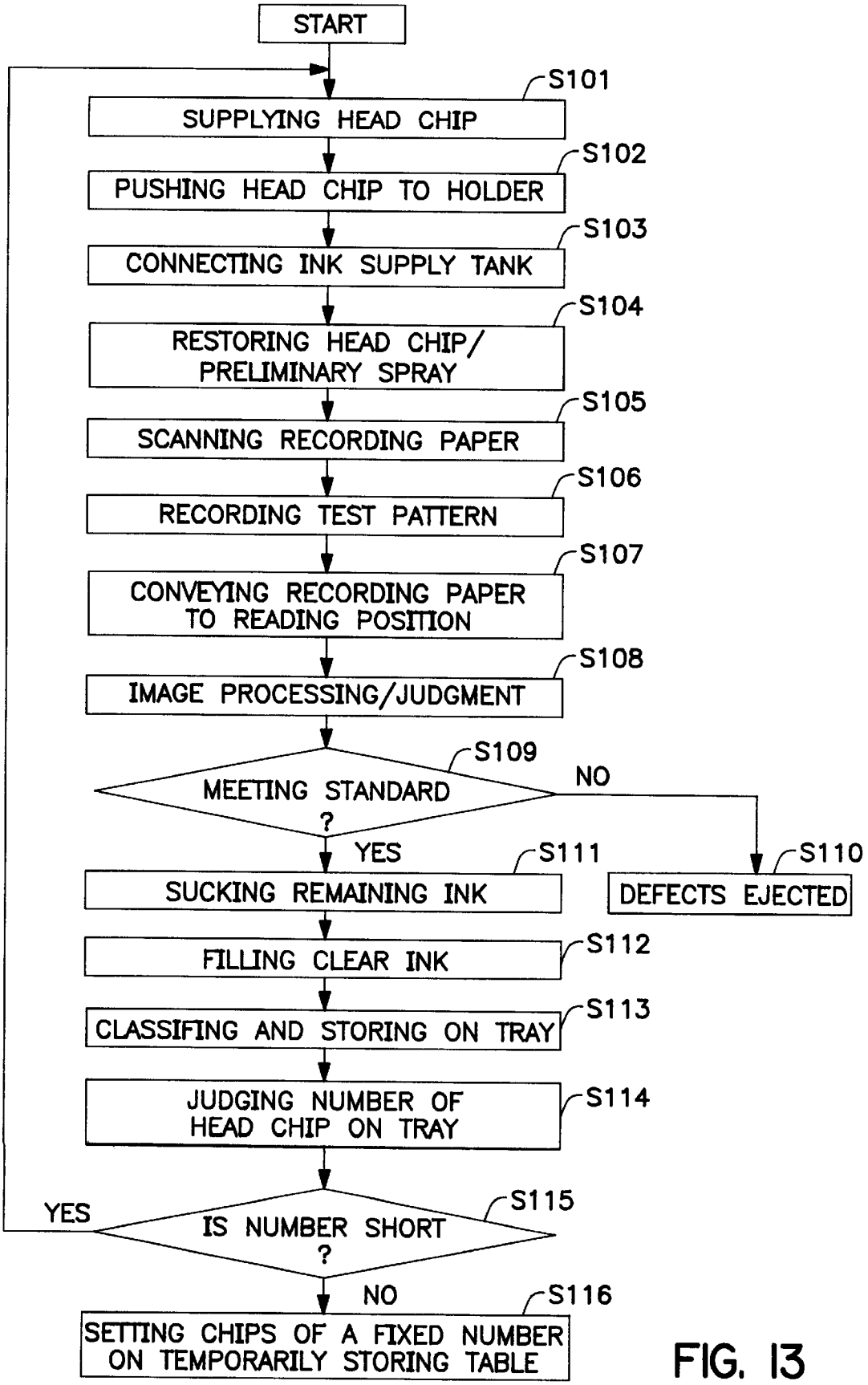
FIGS. 13, 14 are flow charts showing steps of an assembling method for head units according to the second embodiment.
Figure 14:
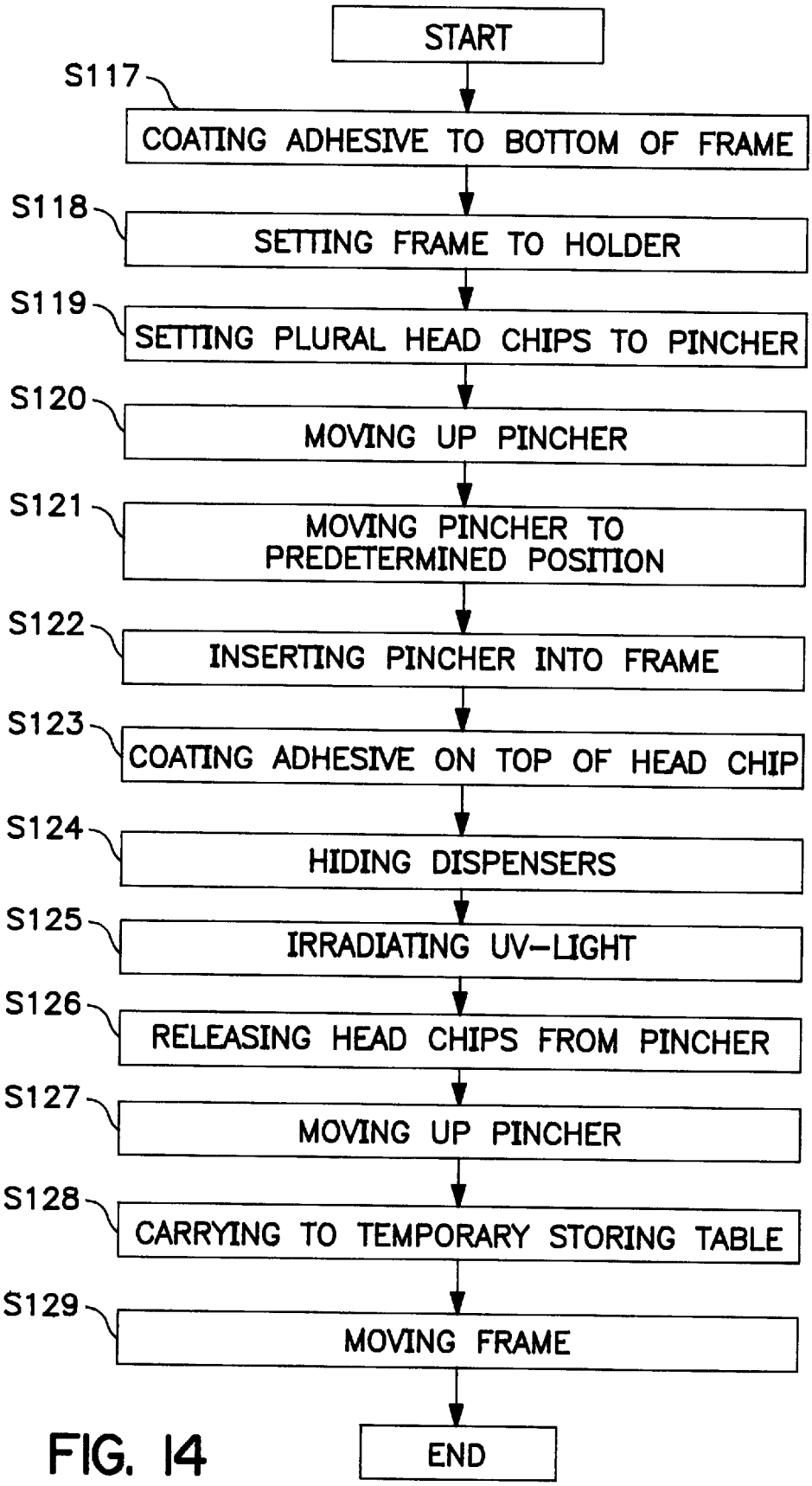

Referring to flow charts shown in FIGS. 13, 14, the process of mounting the head chips C onto the frame 28 will be described as follows. First of all, head chips Cn are supplied to a chip hold member 1*a* by an auto hand (S101), and then the reference faces of the head chips C are put on the holder 1*a* at its holding portions and secured thereon (S102). The head chips Cn held by holder 1*a* are connected with ink supply tanks and contact pins for supplying electrical signals (S103).

If the ink conduit in the head chip C contained air while the head chip C is connected with the ink supply tank, the head chip C would be incapable of discharging enough ink. A recovery not shown in FIG. 13 may suck a fixed amount of ink from the head chip Cn to recover the state of the chip and clean a discharging face, and the head chip Cn may perform practice discharge (S104). After the head chips Cn is cleared by such operations so as to discharge ink normally, the recording paper 1*b* is taken around the take-up roll 1*d* by a fixed amount (S105), and then, a test pattern is recorded on the recording paper 1*b* (S106). The recording paper 1*b* is moved by the movable stage 1*e* into an observational area of the test pattern reading device 2 (S107). During this movement, the stage 1*e* precisely controls the recording start point for the recording paper 1*b* and the stop point in the observation area.

The optical device 2*a* and the image processing device 2*b* read information on the arrival position of ink and dot size from the test pattern (S108), and judge whether the read out result is within the standard (S109). As shown in FIG. 2, the judgment is done by measuring dot size, vertical shift, horizontal shift, and arrival position of ink, and by comparing the measured with the standard. In case that the read out result was out of the standard, the corresponding head chips Cn would be ejected as a defective product by the auto hand 3 (S10).

If the read out result was within the standard, the remaining ink in the head chips C is sucked away (S111), and clear ink not containing dye is filled into the head chips C (SI 12). The purpose of this is to avoid the ink clogging around a discharge opening of the head chip C by the remaining ink. The head chips Cn are classified in accordance with shift amounts of arrival positions of ink, and stored on a tray (not shown) by their class (S113). It is determined as to whether a predetermined number of the head chips in the same class is stacked on the tray (S114, S115), and if the predetermined number of chips Cn are stacked, then the head chips in the same class are arrayed on the temporary storing table 104 (S116). The spacing between the chips at that time is almost the same to one another.

The head chips C1 to C4 arrayed on the temporary storing table 104 are held by chip holder 103C11 to 103 C4 at the same time, as well as arranged at predetermined positions on the frame 28 and fixed by adhesive. More specifically, adhesive applied on the bottoms of the head chips C1 to C4 is applied by applying the adhesive onto the bottom side of the frame 28 to which the bottoms of the head chips adhere. As described in the first embodiment, the adhesive is applied to the predetermined positions on the frame 28 (S117). The adhesive is applied to the frame 28 while the head chips C1 to C4 are arranged on the temporary storing table 104.

The frame 28 to which the adhesive applied is then set to the frame holder 5*a* (S118), and the head chips C1 to C4 are held by the chip holders 103C1 to 103C4 (S119). The chip holders 103C1 to 103C4 are lifted(S120), and the movable table 3*b* is moved along the rails 3*a* (S121). When the movable table 3*b* reaches the predetermined position, the head chips C1 to C4 are inserted into the predetermined positions of the frame 28 by lowering the chip holders 103C1 to 103C4 (S122). At that time the head chip C1 to C4 are held by the chip holders 103C1 to 103C4 without contacting any portion. This is for precisely positioning of the head chips even if the frame 28 has inferior accuracy. According to this, the head chips C1 to C4 can be precisely arranged by mechanical accuracy of the apparatus, namely accuracy of spacing between chip holders 103C1 to 103C4.

Since the head chips C1 to C4 are in the same class in regard to the shift amount of arrival position of ink, when mounted on the frame 28 the plural head chips C1 to C4 are mechanically arranged with the same spacing between them for the arrival positions are less diversified. In other words, the spacing between the chip holders 103C1 to 103C4 can be set to fall at a predetermined pitch. When the head chips C1 to C4 are inserted into the predetermined positions of the frame 28, the adhesive that had been applied on the frame 28 is in turn transferred to the bottoms of the head chips C. The dispensers 105*b*1 to 105*b*4 then apply adhesive to the frame 28 and the tops of the head chips C1 to C4 (S123). After the dispensers 105*b*l to 105*b*4 are shielded from exposure to the ultra-violet light (S124), the adhesive is set by irradiation of the ultra-violet light, so that the head chips C1 to C4 are secured on the frame 28 (S125). After the adhesive becomes hard, the holders 103C1 to 103C4 release the head chips C1 to C4 (S126), and move up (S127); the movable table 3*b* is then moved for taking next head chips C1 to C4 stored on the temporarily storing table 4 (S128). Finally, the frame 28 mounting the head chips C1 to C4 is stored in a proper place (S129).

As described above, the apparatus considerably reduces working time because: the test pattern of the head chip is recorded; the head chips C, only whose arrival position and dot size of ink are within the standard, are classified according to the shifts of the arrival positions; and plural head chips C are mounted on the frame at a single operation. As different from the first embodiment, the movable frame stage 5*f* does not adjust spacing among the head chips C1 to C4, and therefore, the control device for adjustment is not required, so that the apparatus is simply made. In addition, plural head chips C can be incorporated at the same time, so that assembly time will be significantly reduced. It is to be noted that in this embodiment dispersions of shifts of arrival positions of ink in a vertical (Z axis) direction, or a nozzle alignment direction of the head chips C, sufficiently meet the standard from the constitution of the head chip C, so that classification is made only for positional shifts in a horizontal direction.

Third Embodiment

In the second embodiment, the head chips C are classified based on shifts of arrival positions of ink in a chip alignment direction (a horizontal direction), but not classified based on shifts of arrival positions of ink in a vertical direction (Z direction) or a nozzle arrangement direction because their dispersions meet the standard. However, in pursuit of higher print quality, it is necessary to match the arrival positions in the vertical direction. Although such a classification of shift amounts in association with shifts of arrival positions in the vertical direction would be better for obtaining higher print quality, the number of classes would be increased when the apparatus adjusts the shifts in both of vertical and horizontal directions, so that the head chips C in the vertically and horizontally same class might be less obtainable.

This embodiment performs the correction of shifts in the horizontal direction by the classification as well as that of the second embodiment and performs the correction of shift in the vertical direction by putting the head chips C on a temporarily storing table and correcting the shifts in accordance with respective vertical shift amounts. Although an adjustment mechanism for vertical direction can be provided for each of the chip holders 103C1 to 103C4 to obtain the same effect, it is unfavorable because if such movable holders have each adjustment mechanism the weight of the holders themselves would increase and because it is difficult to insert the adjustment mechanism so as to meet the holder's lineup designed to keep a predetermined pitch.

Figure 15:
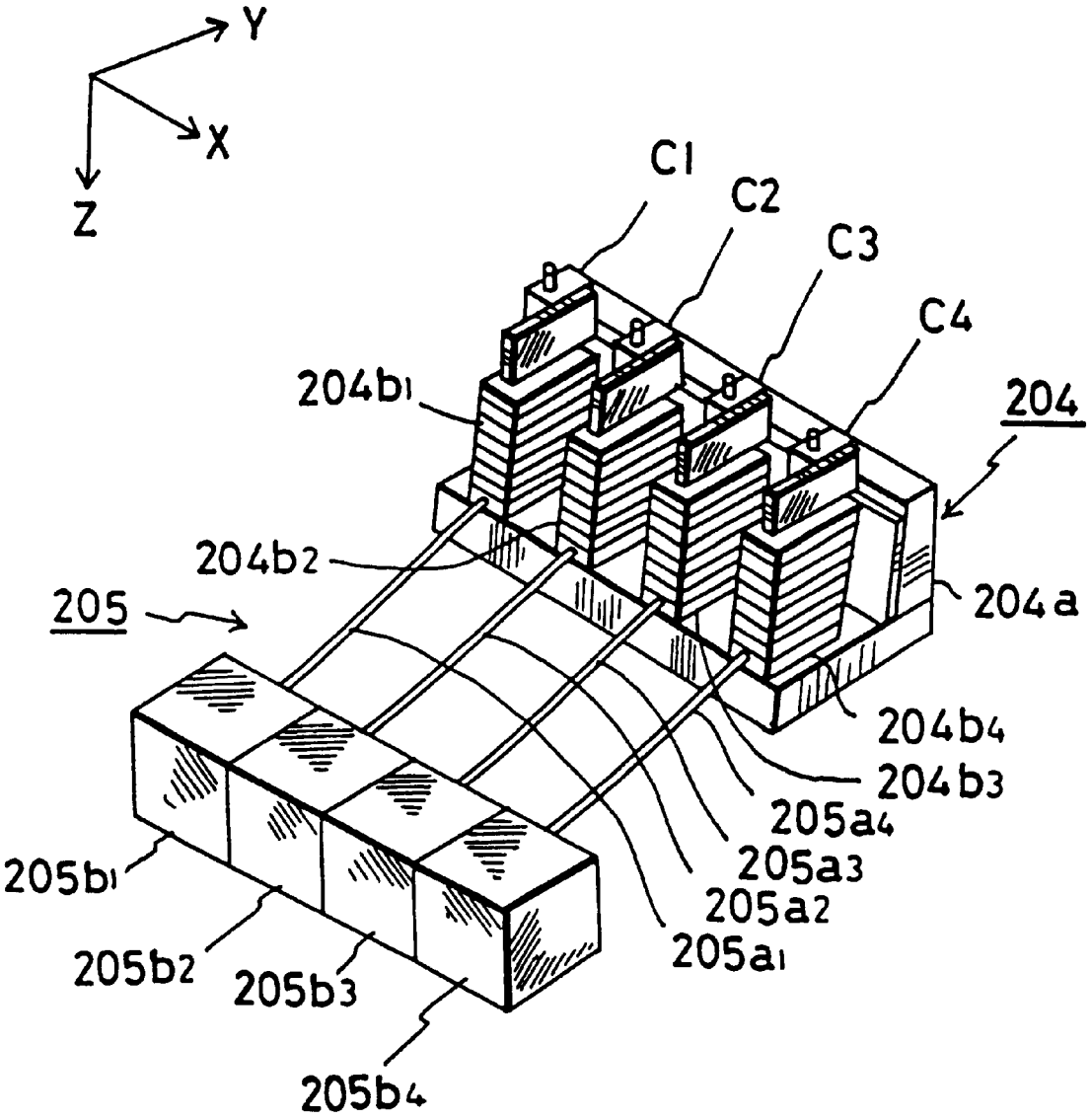
FIG. 15 is a perspective view showing a table for temporarily mounting a head unit according to a third embodiment.

FIG. 15 shows the temporarily storing table 204 equipped with the adjustment mechanism described above, and a level adjustment device 205. The temporary storing table 204 is composed of a body 204 having an L-shaped cross section, piezoelectric elements 204*b*1 to 204*b*4 arranged on the top of the body. The piezoelectric elements 204*b*1 to 204*b*4 are arrayed corresponding to the respective positions where the head chips C are put, and each of the piezoelectric elements 204*b*1 to 204*b*4 is independent of another else. The level adjustment device 205 is composed of dc power supplies 205*b*1 to 205*b*4, and leads 205*a*1 to 205*a*4 coupled to the respective piezoelectric elements 204*b*1 to 204*b*4 and connected to a controller not shown. That is, the piezoelectric elements 204*b*1 to 204*b*4 are constructed so as to be capable of expanding and contracting in the vertical direction by the voltages of the dc power supplies 205*b*1 to 205*b*4. That is, the apparatus is capable of changing the positions in the vertical direction of the head chips on the temporarily storing table 204 by changing, by the controller not shown, voltages at the dc power supplies 205*b*1 to 205*b*4 to adjust the level of the piezoelectric elements 204*b*1 to 204*b*4.

Thus, the head chips C have already corrected the shifts of arrival positions in the vertical direction on the temporarily storing table 204. In the following processes, the head chips C1 to C4 are held by chip holders at the same time, moved on the frame, and made to adhere thereto, as well as in the second embodiment, so that head units are obtainable with less shifts of arrival positions in the vertical direction. Although in this embodiment, multilayered piezoelectric elements are used because the pitch between head chips is narrow, if physically possible to be arrayed, an ordinary Z stage can be used for achieving the same effect.

Constitution of Ink Jet Recording Apparatus

Figure 16:
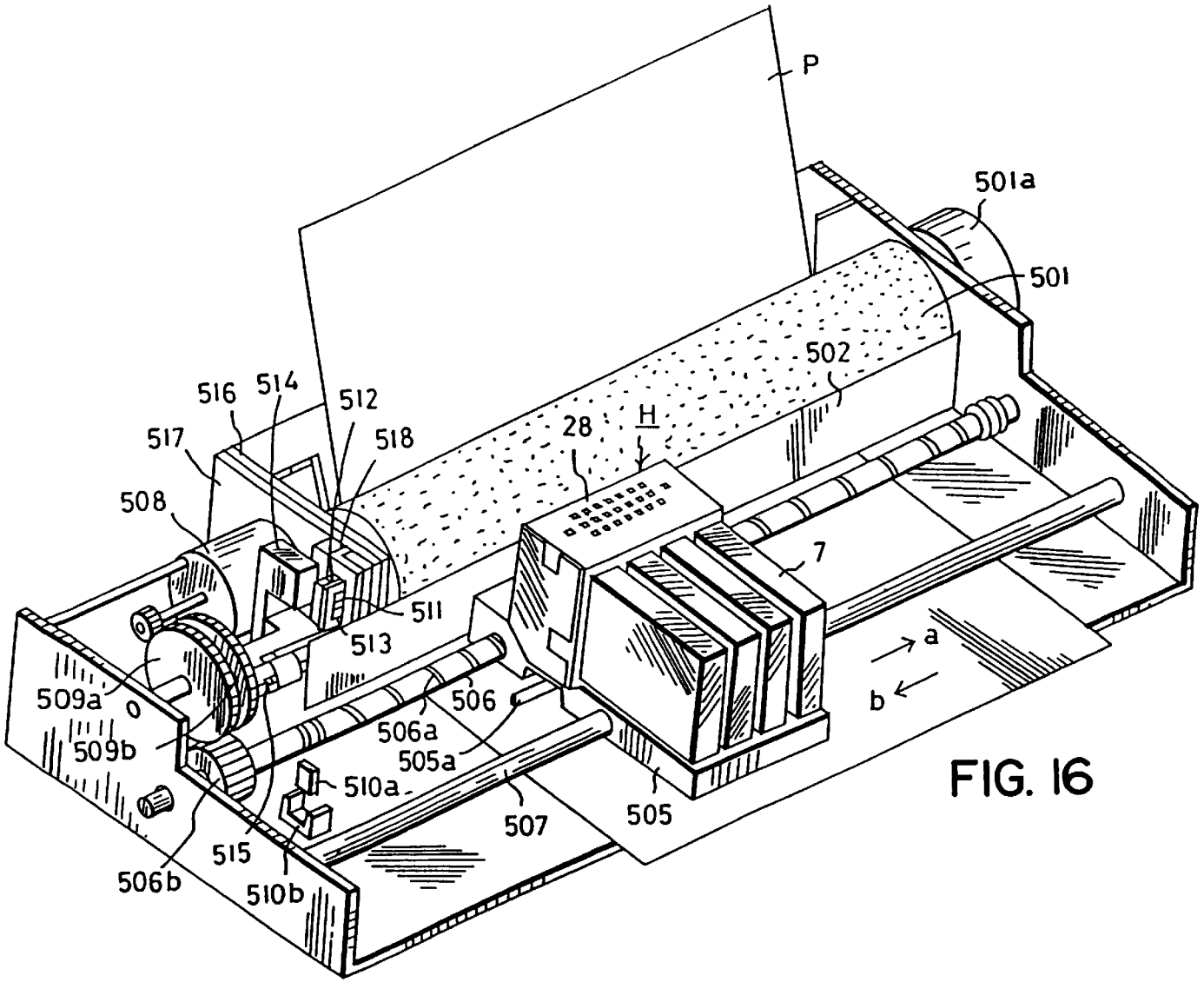
FIG. 16 is a perspective view showing an ink jet recording apparatus.

Finally, an ink jet recording apparatus incorporating a head unit assembled from the methods described as the first or second embodiment, will be described. As shown in FIG. 16, a platen 501 as conveying means conveys a recording sheet P as of recording material to be recorded and supports the recording sheet P at its recording position. A knob 501*a* operative to rotate by hand is provided on one end of the rotation axis of the platen 501. A pushing plate 502 for pushing the recording sheet P conveyed at the recording portion is located in front of the platen 501.

The head unit H incorporating the plural head chips C1 to C4 in the frame 28 is coupled with the respective ink supply tanks 7, from which respective colors are supplied. A color recording is performed by discharging inks onto the recording sheet P conveyed by the platen 501 in response to signals. These head unit H and ink supply tanks 7 are mounted on the carriage 505 and reciprocally traveled in a sub-scanning direction (arrows a, b direction). The carriage 505 is connected to a screw shaft 506 drilled with a helix groove 506*a*; a gear 506*b* for screw is fixed to an end of the screw shaft 506. A guide rail 507 whose both ends are supported by the apparatus body penetrates the carriage 505.

The material of the carriage 505 is selected so that the carriage has a sufficiently rigid structure in accordance with the surrounding circumstances of the apparatus body. In this embodiment, PPS (poly phenylene sulfate) resin with filler is used. Drive force of a drive motor 508 as a drive source is transmitted to the screw shaft 506 through a drive transmission gear 509*a* and the gear 506*b* for screw. Accordingly, by rotating normally and reversely the drive motor 508, the drive force is transmitted through the drive transmission gear 509*a* and the gear 506*b* for screw, and the carriage is thereby moved reciprocally in the directions of arrows a, b.

The carriage 505 is formed with a lever 505*a*. By detecting the lever 505*a* through photo couplers 510*a*, 510*b* arranged at the end of the movable range of the carriage 505, a home position (waiting position) of the carriage 505 is detected to switch the rotation direction of the drive motor 508. The cap member 511 is for restituting process of the ink discharge opening of the head unit and supported unitedly by a support 512. The support 512 is formed with sucking means not shown. The cap member 511 has an opening 513, which is covered over the nozzles of the head unit to recover it by sucking through the sucking means. The recover lever 514 is to initiate the recover process. A cam 515 contacting to the carriage 505 at a time that the carriage 505 returns at the home position is moved along the motion of the recover lever, and the drive force from the drive motor 508 controls the motion of the carriage through the drive transmission gear 509 and known transmission means such as a clutch.

A support plate 517 is attached to a chassis 516 of the apparatus body, and a cleaning blade 518 is supported on the support plate 517 so as to be capable of contacting the discharge opening. The cleaning blade 518 is moved backward and forward by drive means not shown to wipe out the ink droplets attached round the discharge opening. Not only shown one but also other known constitutions can, as a matter of course, be applied to the shape of the cleaning blade 518. Respective processes of capping, cleaning, and sucking for recover are conducted at predetermined timing and at a corresponding position in accordance with motion of the screw shaft 506 when the carriage 505 is moved into the home position side area.

According to such an ink jet recording apparatus, the frame 28 incorporating with the head chips C is mounted on the carriage 505 and easily replaced by connecting the ink supply tanks 7 and the contact pins (not shown) for supplying electrical signals, to the head chips C.

Other Embodiments

Although in the embodiment described above, ink jet recording system is used as a recording method, it is preferable to constitute so that electrothermal transducers are excited according to the recording signals, that thermal energy applied from the transducer boils ink to produce bubbles, and that the bubbles expand and contract to emit, for recording, the ink through the discharge opening.

As typical constitution and concept, fundamental concept disclosed in, such as, the U.S. Pat. No. 4,723,129 and U.S. Pat. No. 4,740,796, is preferred. This method is applicable to any of so called on-demand type and continuous type, and in particular it is effective for the on-demand type because thermal energy is produced at electrothermal transducers located corresponding to a sheet or passage which is holding liquid (ink), in response to at least an applied drive signal corresponding to recording information for rapidly heating of exceeding the boiling of ink, thereby producing boil in layer and resulting in forming bubbles in liquid corresponding and with respect to the drive signal. The liquid is discharged through the discharge opening by expanding and contracting of the bubbles to produce at least one droplet. If the drive signal is a pulse signal, the signal expands and contracts the bubbles properly and instantaneously, thereby irrediating bubbles satisfactorily.

Signals such as disclosed in U.S. Pat. No. 4,463,359 and U.S. Pat. No. 4,345,262 are suitable as a pulse drive signal. If the condition is set as disclosed in U.S. Pat. No. 4,313,124 in which the invention concerns thermal increasing ratio on a thermal operation face, the recording apparatus can record in a superior way. Regarding to the constitution of the head chip, this invention includes constitutions disclosed in U.S. Pat. No 4,558,333 and U.S. Pat. No. 4,459,600 in which a thermal operator is provided at a curving portion, in addition to the combination, as disclosed in U.S. Patents cited above, of the discharge opening, the passage, and the electrothermal transducer (having liner passage or passage in a right angle).

The invention can be constituted in accordance with. Japanese Unexamined Patent Publication No. Showa 59-123,670 in which a common slit for plural electrothermal transducers is used for a discharge opening of the electrothermal transducers or with Japanese Unexamined Patent Publication No. Showa 59-138,461 in which an opening for absorbing pressure wave of thermal energy corresponds to the discharge opening. It is preferable for the invention to add, as of constitution of the ink jet recording apparatus, recover means for head chips, preliminary supplemental means, or the like because it renders the effect of the invention more stable. More specifically, it is effective, in order to record stably, to use capping means for head chips, cleaning means, pressuring or absorbing means, and preheating means including elements of electrothermal transducer type or other thermal elements, or their combinations, as well as to perform preliminary discharge mode for demonstrating discharge not for recording.

In addition, although in the embodiment described above an ink is described as liquid, an ink suitable for the invention can be an ink which is hardened at a room temperature or below and is soften or liquidized at a room temperature, or, specially for ink jet recording method generally performing thermally control of the ink itself from 30° C. or above to 70° C. or below so that the ink's viscosity is kept in a stable range for discharge, can be an ink which is liquidized at a time that the recording signal is applied for use.

Moreover, it is applicable where ink is liquidized by application of thermal energy in response to recording signals to discharge liquid ink through ink's phase changes from solid phase to liquid phase as to positively prevent ink's temperature from increasing due to thermal energy, through use of any ink becoming solid when neglected for prevention of ink's vaporizing, or through anyway, or where ink liquidized by nothing else thermal energy, such as, one beginning to solidify when reaching the recording sheet, is used. Such ink can be formed in states held, so as to face toward the electrothermal transducers, as liquid or solid substance to porous sheet's recesses or through holes, as disclosed in Japanese Unexamined Patent Publication No. 54-56,847 or No. 60-71,260. The most effective method for the respective inks is to execute the layer boil method as described above.

Furthermore, the ink jet recording apparatus can be formed as terminals for image output of information processing systems such as computers, photocopiers combined with an image reader, and facsimiles having transmission and receiving capability.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A method of assembling a recording head unit comprising a plurality of head chips mounted on a frame for discharging an ink, said head chips having relative positions with respect to each other, said method comprising the steps of:

determining the relative positions among said head chips by measuring an arrival position of ink elected from each of said head chips and, if necessary, correcting for a shift in the arrival position of the ink; and securing said head chips onto said frame taking into account the correcting for the shift in the arrival position of the ink so as to maintain the relative positions among said head chips without said head chips contacting said frame by positioning adhesive between said head chips and said frame.

2. A method of assembling head units as set forth in claim 1, wherein said relative positions of said head chips are determined by recording a test pattern using said head chips and by using an ink arrival position information determined from said test patterns.

3. A method of assembling head units as set forth in claim 2, further comprising the steps of:

judging whether an arrival position quality of said head chips meets a standard value which is based on said ink arrival position information determined from said test patterns, and selecting only those of the head chips which meet the standard for the securing onto said frame.

4. A method of assembling head units as set forth in claim 2, further comprising the step of correcting said relative positions of said head chips at a time such that said head chips are secured onto said frame using said ink arrival position information determined from said test patterns.

5. A method of assembling head units as set forth in claim 2, further comprising the step of correcting said relative positions of said head chips by combining those of the head chips that have close shifts of the arrival positions of ink with one another using said ink arrival position information determined from said test patterns and by securing the head chips onto said frame so as to maintain said relative positions.

6. A method of assembling head units as set forth in claim 2, further comprising the steps of:

using said ink arrival position information determined from said test patterns;

adjusting a level of a temporary storing table for temporarily storing the head chips, at which said head chips are stored; and securing the head chips onto said frame so as to maintain said relative positions.

7. A method of assembling head units as set forth in claim 1, wherein said head chips are positioned without pushing against a wall of said frame and said head chips are caused to adhere so as to be secured to at least two points of an end face of said respective head chips in a condition such that the chips are separated from said frame.

8. A method of assembling head units as set forth in claim 7, wherein said head chips are caused to adhere by at least two types of adhesive in which at least a first type of adhesive is an ultraviolet system adhesive and a second type of adhesive is a silicon resin system adhesive.

* * * * *

UNITED STATES PATENT AND TRADEMARK OFFICE

CERTIFICATE OF CORRECTION

PATENT NO. : 5,964,032

DATED : October 12, 1999

INVENTOR(S) : TSUYOSHI ORIKASA ET AL.

It is certified that error appears in the above-identified patent and that said Letters Patent is hereby corrected as shown below:

COLUMN 1:

Line 9, "5-130,090," should read --5-130090,--; and
Line 10, "5-130,093," should read --5-130093,--.

COLUMN 5:

Line 40, "does" should read --do--.

COLUMN 7:

Line 46, "can" should be deleted.

COLUMN 8:

Line 32, "with" should be deleted; and
Line 64, "become" should read --becomes--.

COLUMN 9:

Line 62, "recovery" should read --recovery device--.

COLUMN 10:

Line 20, "(SI 12)." should read --(S112).--;
Line 27, "is" should read --are--; and
Line 33, "103C11" should read --103C1--.

UNITED STATES PATENT AND TRADEMARK OFFICE

CERTIFICATE OF CORRECTION

PATENT NO. : 5,964,032

DATED : October 12, 1999

INVENTOR(S) : TSUYOSHI ORIKASA ET AL.

It is certified that error appears in the above-identified patent and that said Letters Patent is hereby corrected as shown below:

COLUMN 12:

Line 3, "another else." should read --another.--

COLUMN 13:

Line 63, "to" should be deleted.

COLUMN 14:

Line 2, "liner" should read --linear--;
Line 5, "59-123,670" should read --59-123670--;
Line 8, "59-138,461" should read --59-138461--;
Line 25, "thermally" should read --thermal--;
Line 36, delete "nothing else"; and
Line 43, "54-56,847 or No. 60-71,260." should read --54-6847 or No. 60-71260.--.

Signed and Sealed this

Third Day of April, 2001

*Attest:*

Nicholas P. Godici

NICHOLAS P. GODICI

*Attesting Officer*

*Acting Director of the United States Patent and Trademark Office*